United States Patent [19]

Pedersen

[11] 4,140,113

[45] Feb. 20, 1979

[54] BREATHING APPARATUS

[75] Inventor: Vernon G. Pedersen, Chicago, Ill.

[73] Assignee: Dacor Corporation, Northfield, Ill.

[21] Appl. No.: 830,588

[22] Filed: Sep. 6, 1977

[51] Int. Cl.[2] ..... A62B 7/00

[52] U.S. Cl. ..... 128/142.2; 137/494; 137/DIG. 9

[58] Field of Search ..... 128/142.2, 142 R, 147, 128/210; 137/494, DIG. 9

[56] References Cited

U.S. PATENT DOCUMENTS 2,893,386 7/1959 Sajeck ..... 128/147 X 4,041,977 8/1977 Matsuno ..... 128/142.2 X

FOREIGN PATENT DOCUMENTS 935911 9/1963 United Kingdom ..... 137/DIG. 9

*Primary Examiner*—Henry J. Recla

*Attorney, Agent, or Firm*—Edmond T. Patnaude

[57] ABSTRACT

A demand regulator for use in underwater breathing employs a deflector carried by a valve operating lever for movement between the air outlet in the breathing chamber and the mouthpiece tube to reduce the portion of air supplied directly to the mouthpiece as the air flow is increased.

5 Claims, 4 Drawing Figures

BREATHING APPARATUS

The present invention relates in general to pressure regulation in self contained breathing systems such as used, for example, in SCUBA diving, and it relates more particularly to a new and improved method and means for improving the breathing characteristics of a demand type pressure regulator by automatically adjusting the venturi action in the regulator as the rate of flow of air through the regulator changes.

BACKGROUND OF THE INVENTION

Pressure regulators such as those used in underwater breathing apparatus commonly employ the pressure differential between the ambient and a breathing chamber in the regulator to operate an air valve which supplies air to the breathing chamber. This is accomplished by mounting a flexible diaphragm across an opening in the wall of the breathing chamber and using the diaphragm to actuate the air valve. Since the mouthpiece is connected to the breathing chamber the diver breaths from the breathing chamber. In single hose regulators the diver also exhales through the breathing chamber to the ambient while in double hose regulators the exhaled gasses go directly to the ambient.

When the diver commences to inhale while the air inlet valve is closed, the pressure in the breathing chamber is reduced causing the diaphragm to be sucked into the breathing chamber and thereby open the air inlet valve. When the user exhales, the pressure in the breathing chamber increases to cause the diaphragm to move out and thereby to close the air inlet valve. In order to reduce the effort required to breath from such regulators it is common practice to design the regulator so that a portion of the inlet air travels as a jet directly into the mouthpiece tube, thereby to provide a so-called venturi effect which educts air from the breathing chamber and thus reduces the pressure in the breathing chamber. Consequently, the diaphragm is held in the pulled in position by the venturi action and holds the air inlet valve open. While such a venturi effect makes it easier for the user to inhale from the regulator, exhaling becomes more difficult inasmuch as the venturi action must be overcome before the air inlet valve can be closed. Accordingly, the amount of venturi action provided must be carefully adjusted for optimum inhalation and exhalation.

In the prior art regulators the amount of venturi action is at a maximum when the air inlet valve is fully open. However, it is while the air inlet valve is fully open that exhalation ordinarily occurs. On the other hand, the need for the venturi action is greatest when inhalation commences and the air inlet valve begins to open. Yet the air flow rate is low at this time wherefor the venturi action is also low.

SUMMARY OF THE INVENTION

Briefly, in accordance with the present invention there is provided a new and improved breathing apparatus including a demand regulator wherein the portion of the inlet air which is directed into the mouthpiece to provide the venturi action is automatically reduced as the air flow rate increases. In a preferred embodiment of the invention an air deflector is carried by the air inlet valve actuator so as to move into the space between the mouthpiece tube and an air inlet port to deflect an increasingly greater portion of air away from the mouthpiece tube as the actuator is moved toward a fully open position. In this manner a substantial amount of venturi action can be provided when the air inlet valve is only slightly open without providing an excessive venturi action when the air inlet valve is fully open. As a consequence, the present invention reduces the breathing effort required of the person using the regulator.

GENERAL DESCRIPTION OF THE DRAWING

The present invention will better understood by a reading of the following detailed description taken in connection with the accompanying drawing wherein.

DETAILED DESCRIPTION OF THE INVENTION

Figure 1:
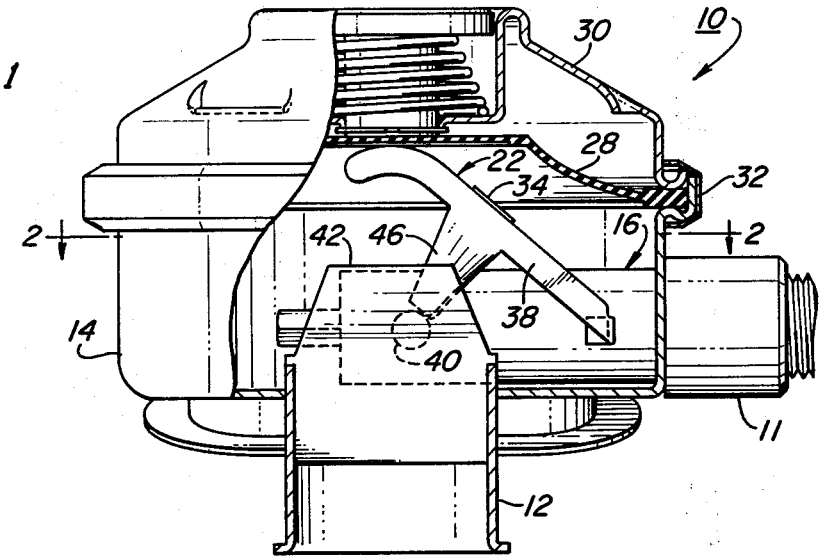
FIG. 1 is a side view, partly in cross-section of a single hose demand regulator embodying the present invention, the air inlet valve being shown in the fully closed position.
Figure 2:
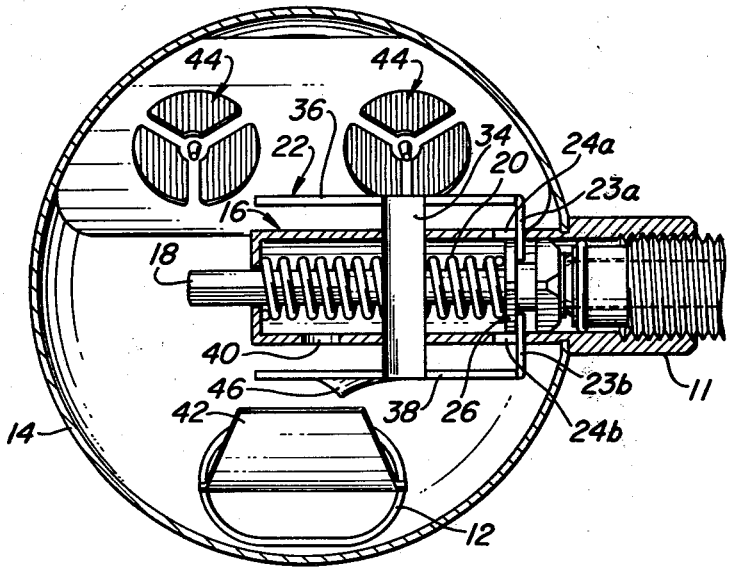
FIG. 2 is a sectional view taken along the line 2—2 of FIG. 1.

With particular reference to FIGS. 1 and 2, an underwater breathing apparatus includes a single hose demand type pressure regulator 10 which controls the flow of air from an air inlet hose 11 to a breathing or mouthpiece tube 12. The hose 11 is normally connected to a source of air under pressure such, for example, as a first stage pressure regulator mounted to an air supply tank. The demand regulator 10 comprises a cup-shaped housing member 14 through the bottom of which the mouthpiece tube 12 extends. It will be understood by those skilled in that art that a soft mouthpiece (not shown) fits over the distal end of the tube 12 for receipt in the mouth of the user. An air inlet valve 16 is fixedly mounted in the bottom of the housing member 14 in a diametric direction as best shown in FIG. 2. A valve member 18 is slidably disposed within the tubular housing of the inlet valve 16 and is biased into a closed position by means of a coil spring 20. A more complete description of the air inlet valve 16 may be found in MacNiel U.S. Pat. No. 3,633,611. A valve actuator 22 is provided with a pair of rectangular arms **23*a* and 23*b* which extend through rectangular openings 24*a* and 24*b* in opposite sides of the tubular housing of the air inlet valve 16 into engagement with an annular flange 26 on the valve member 18. As is best described in the said patent as the actuator 22 is pivoted in a counterclockwise direction the valve stem or valve element 18** is moved to the left as viewed in FIG. 2 thereby to open the valve and permit air to flow into the regulator.

In order to cause the air inlet valve to open when the diver inhales, a flexible diaphragm 28 is sealably mounted across the upper open end of the housing member 14. More particularly, an apertured cover member 30 is positioned over the diaphragm 28 and the peripheral portion of the diaphragm 28 is compressed between the peripheral edges of the housing member 14 and the cover 30 by means of an annular clamping member 32. With reference to FIG. 2 it may be seen that the actuator 22 includes a cross part 34 which interconnects the side portions 36 and 38. When the pressure within the breathing chamber defined by the walls of the housing member 14 and the diaphragm 28 is reduced by the diver inhaling through the mouthpiece 12, the ambient pressure on the external side of the diaphragm pushes the diaphragm into the breathing chamber thereby pivoting the valve actuator 22 in a counterclockwise direction as viewed in FIG. 1. This causes the air inlet valve to open whereby air enters the breathing chamber through the spaces around the legs 23*a* and 23*b* of the actuator member and also through a port 40. The air flowing out through the port 40 impinges on a baffle 42 which deflects the air directly down the mouthpiece tube 12. This direct flow of air from the port 40 into the mouthpiece tube provides the venturi action which educts air from the breathing chamber thereby to maintain the pressure in the breathing chamber below ambient pressure. The ratio of the amount of air entering the breathing chamber through the spaces around the actuator arms 23*a* and 23*b* to the air flowing directly into the mouthpiece from the tube 40 determines the amount of venturi action provided and thus the breathing effort required to hold the valve open. Ordinarily this venturi effect is adjusted to provide what is known as "free-flow". By "free-flow" is meant that characteristic of the regulator wherein once the air inlet valve has been opened by the diver inhaling through the mouthpiece, the valve is held open by the venturi action until the diver interrupts the flow of air out through the mouthpiece tube 12. When the person using the regulator exhales into the mouthpiece tube 12, the increased pressure in the breathing chamber causes the diaphragm 28 to move outwardly whereby the spring 20 in the air inlet valve moves the valve element 18 into the closed position. The exhaust gases from the lungs of the user exit to the ambient through the breathing chamber and the check valves. 44.

Figure 3:
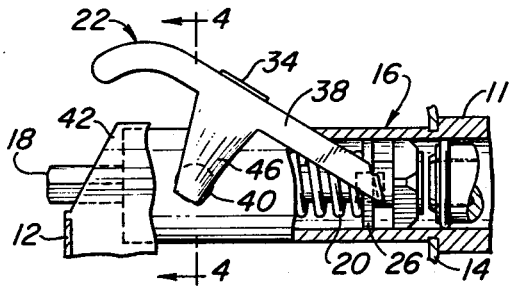
FIG. 3 is a view of the air inlet valve housing and valve actuator similar to that of FIG. 1 but showing the air inlet valve in a fully open position.
Figure 4:
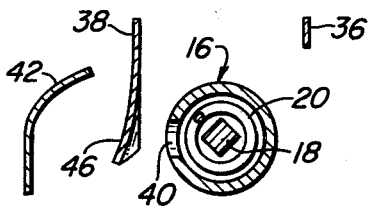
FIG. 4 is a sectional view taken along the line 4—4 of FIG. 3.

In order to reduce the venturi effect when the air inlet valve is in a substantially fully open position, thereby to facilitate exhalation by the diver, a baffle-like deflector 46 is carried by one arm of the valve actuator 22 so as to be positioned in the space through which the air flows from the air inlet port 40 to the mouthpiece tube 12 when the air inlet valve is substantially fully open. Consequently, when the deflector baffle 46 is opposite the port 40 as shown in FIG. 3, a portion of the air exiting the port 40 is deflected away from the baffle 42 so as to enter the breathing chamber rather than flow as a jet or stream directly down into the mouthpiece tube. Consequently the ratio of air flowing directly into the mouthpiece tube 12 to the air otherwise entering the breathing chamber is decreased when the air inlet valve is fully open. The exact construction of the deflector baffle 46 depends on the desired breathing characteristics of the regulator. This is a subjective characteristic of the regulator since different people prefer different amounts of the venturi assist in the regulator. However, with the particular embodiment disclosed herein, the deflector baffle 46 can be twisted in order to adjust the variation in venturi action which is provided thereby as the actuator moves from the fully closed position as shown in FIG. 1 to the fully open position as shown in FIG. 3. Moreover, for any particular desirable breathing characteristics, the desired effect of the deflector 46 is dependent on the volumetric flow of air through the regulator when the air inlet valve 16 is fully open. Some regulators are designed for substantially higher flow rates than are others but irrespective of such flow rates the present invention provides the advantage of reducing the variation in venturi action between the condition where the air inlet valve is slightly open and the condition where the air inlet valve is fully open.

While the present invention has been described in connection with a particular regulator, it will be understood by those skilled in the art that the basic concept of varying the effective venturi action as the air inlet flow varies can readily be incorporated in other regulator designs which employ venturi action to assist in maintaining the air inlet valve open.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. Breathing apparatus for use with a source of compressed air comprising a housing having a recess therein, a diaphragm mounted across said recess to define a chamber in said housing, a breathing port opening through said housing into said chamber, an air valve mounted to said housing and having an air inlet for connection to said source of compressed air and an air outlet port opening into said chamber, said air outlet port being disposed so as to direct a stream of air from said outlet port into said breathing port thereby to develop a venturi action in said regulator by reducing the pressure in said chamber, a valve element in said air valve movable between a fully open position and a fully closed position, actuator means connected between said valve element and said diaphragm for moving said valve element in response to the movement of said diaphragm, and venturi control means in said housing operatively associated with said actuator means, and thereby responsive to the position of said valve member for varying the amount of air flowing in a stream from said air outlet port into said breathing port, whereby the effect of the venturi action of said regulator is controlled in inverse relation to the volume of air flow from said air valve.

2. Breathing apparatus according to claim 1 wherein said venturi control means comprises a deflector movable across said air outlet port.

3. Breathing apparatus according to claim 2 wherein said actuator means comprises a lever, and said deflector is mounted to said lever for movement through the space between said air outlet port and said breathing tube.

4. Breathing apparatus according to claim 3 wherein said deflector is an integral part of said lever.

5. Breathing apparatus according to claim 2 wherein said deflector is shaped so as to deflect an increasing amount of air from said air outlet port into said chamber as said valve element is moved toward said fully open position.

* * * * *